US007828287B2

(12) United States Patent
Chai et al.

(10) Patent No.: US 7,828,287 B2
(45) Date of Patent: Nov. 9, 2010

(54) PRINTER STAR WHEEL

(75) Inventors: Song Poh Chai, Singapore (SG); Umashankar Koggri Giddappa Godwa, Singapore (SG); Tai Leung Tsui, Singapore (SG); Wai Kiat Foo, Singapore (SG); Kuan Meng Chin, Singapore (SG); Poovendhran S/O Kannayah, Singapore (SG)

(73) Assignee: Dell Products L.P., Round Rock, TX (US)

( * ) Notice: Subject to any disclaimer, the term of this patent is extended or adjusted under 35 U.S.C. 154(b) by 0 days.

(21) Appl. No.: 12/362,296

(22) Filed: Jan. 29, 2009

(65) Prior Publication Data

US 2010/0187751 A1 Jul. 29, 2010

(51) Int. Cl.
*B65H 29/00* (2006.01)

(52) U.S. Cl. ..... 271/184; 492/33

(58) Field of Classification Search ..... 492/33, 492/28, 30

See application file for complete search history.

(56) References Cited

U.S. PATENT DOCUMENTS

| | | | | | |
|---|---|---|---|---|---|
| 685,370 | A | * | 10/1901 | Bridgewater | 271/119 |
| 4,047,185 | A | | 9/1977 | Phillips et al. | 346/140 R |
| 4,083,389 | A | | 4/1978 | Rosen et al. | 141/179 |
| 4,369,963 | A | | 1/1983 | Jamieson, Jr. | 271/204 |
| RE31,393 | E | | 9/1983 | Rosen | 141/179 |
| 4,665,823 | A | | 5/1987 | Hightower | 101/232 |
| 4,685,347 | A | | 8/1987 | Roehrig et al. | 74/436 |
| 4,687,192 | A | * | 8/1987 | Hunt | 271/119 |
| 4,713,991 | A | | 12/1987 | Gaug | 81/176.1 |
| 4,947,695 | A | | 8/1990 | Lohr | 73/863.01 |
| 5,082,105 | A | | 1/1992 | Tincati | 198/473.1 |
| 5,163,674 | A | * | 11/1992 | Parks | 271/274 |
| 5,205,228 | A | | 4/1993 | Mitchell | 111/89 |
| 5,420,621 | A | | 5/1995 | Richtsmefer et al. | 347/104 |
| 5,669,488 | A | | 9/1997 | Burger | 200/528 |
| 5,772,001 | A | | 6/1998 | Otruba et al. | 198/459.2 |
| 5,784,857 | A | | 7/1998 | Ford et al. | 53/201 |
| 5,850,233 | A | * | 12/1998 | Otsuka et al. | 346/136 |
| 6,488,279 | B1 | * | 12/2002 | Fukuda et al. | 271/314 |
| 6,666,449 | B2 | | 12/2003 | DeFosse et al. | 271/187 |
| D511,867 | S | | 11/2005 | Weiser et al. | D30/124 |
| 2004/0183850 | A1 | * | 9/2004 | Takeuchi et al. | 347/19 |
| 2007/0034223 | A1 | * | 2/2007 | Dumler et al. | 132/218 |

* cited by examiner

*Primary Examiner*—Gene Crawford
*Assistant Examiner*—Gerald W McClain
(74) *Attorney, Agent, or Firm*—Baker Botts L.L.P.

(57) ABSTRACT

A printer includes a housing, one or more print cartridges, and a positioning system configured to position print media for printing by the one or more print cartridges. The positioning system including a rotatable star wheel for translating the print media relative to the housing, the star wheel including a plurality of teeth disposed around an outer perimeter of the star wheel. At least the tips of the star wheel teeth are formed from plastic.

12 Claims, 3 Drawing Sheets

PRINTER STAR WHEEL

TECHNICAL FIELD

The present disclosure relates in general to printers, and more particularly to star wheels for moving a photo through a printer.

BACKGROUND

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Many information handling systems include printers for printing documents, photos, or other data from the information handling systems. Many ink printers (e.g., inkjet photo printers) include metal star wheels to hold the print media (e.g., paper) firmly as the print media is moved through the print zone. Once ink is deposited on the print media and the print media is moved through the star wheel structure, the star wheels often create markings or tracks on the print media. To illustrate, FIG. 1 shows an example photo 10 having star wheel tracks 12.

In a photo paper structure, the teeth of the metal star wheels typically penetrate into the polyethylene layer of the printed media in order to produce enough friction to transport the paper. For example, as shown in FIG. 2, the star wheel teeth may penetrate through a super coating layer and a photographic emulsion layer, and into a polyethylene layer. This may create white dots or other marks on the surface of the photo paper, e.g., as shown in FIG. 1. If the metal star wheel teeth do not penetrate into the polyethylene layer, there may be insufficient frictional force and the teeth may slip on the surface of the paper.

SUMMARY

In accordance with certain embodiments of the present disclosure, a printer includes a housing, one or more print cartridges, and a positioning system configured to position print media for printing by the one or more print cartridges. The positioning system including a rotatable star wheel for translating the print media relative to the housing, the star wheel including a plurality of teeth disposed around an outer perimeter of the star wheel. The star wheel, or at least the star wheel teeth, is formed from plastic.

In accordance with certain embodiments of the present disclosure, a star wheel for a printer includes an outer perimeter, and a plurality of teeth disposed around the outer perimeter, wherein the teeth are formed from plastic. The star wheel is configured for translating a print media being printed to without forming star wheel marks or tracks on a surface of the print media.

In accordance with certain embodiments of the present disclosure, a printer includes a housing, one or more print cartridges, and a positioning system configured to position print media for printing by the one or more print cartridges. The positioning system including a rotatable star wheel for translating the print media relative to the housing, the star wheel including a plurality of teeth disposed around an outer perimeter of the star wheel. The star wheel is formed from plastic, and the tip of each star wheel tooth has a radius between about 0.025 mm and about 0.035 mm.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

Preferred embodiments and their advantages are best understood by reference to FIGS. 3-7, wherein like numbers are used to indicate like and corresponding parts.

For the purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, an information handling system may be a personal computer, a PDA, a consumer electronic device, a network storage device, or any other suitable device and may vary in size, shape, performance, functionality, and price. The information handling system may include memory, one or more processing resources such as a central processing unit (CPU) or hardware or software control logic. Additional components or the information handling system may include one or more storage devices, one or more communications ports for communicating with external devices as well as various input and output (I/O) devices, such as a keyboard, a mouse, and a video display. The information handling system may also include one or more buses operable to transmit communication between the various hardware components.

Figure 3:
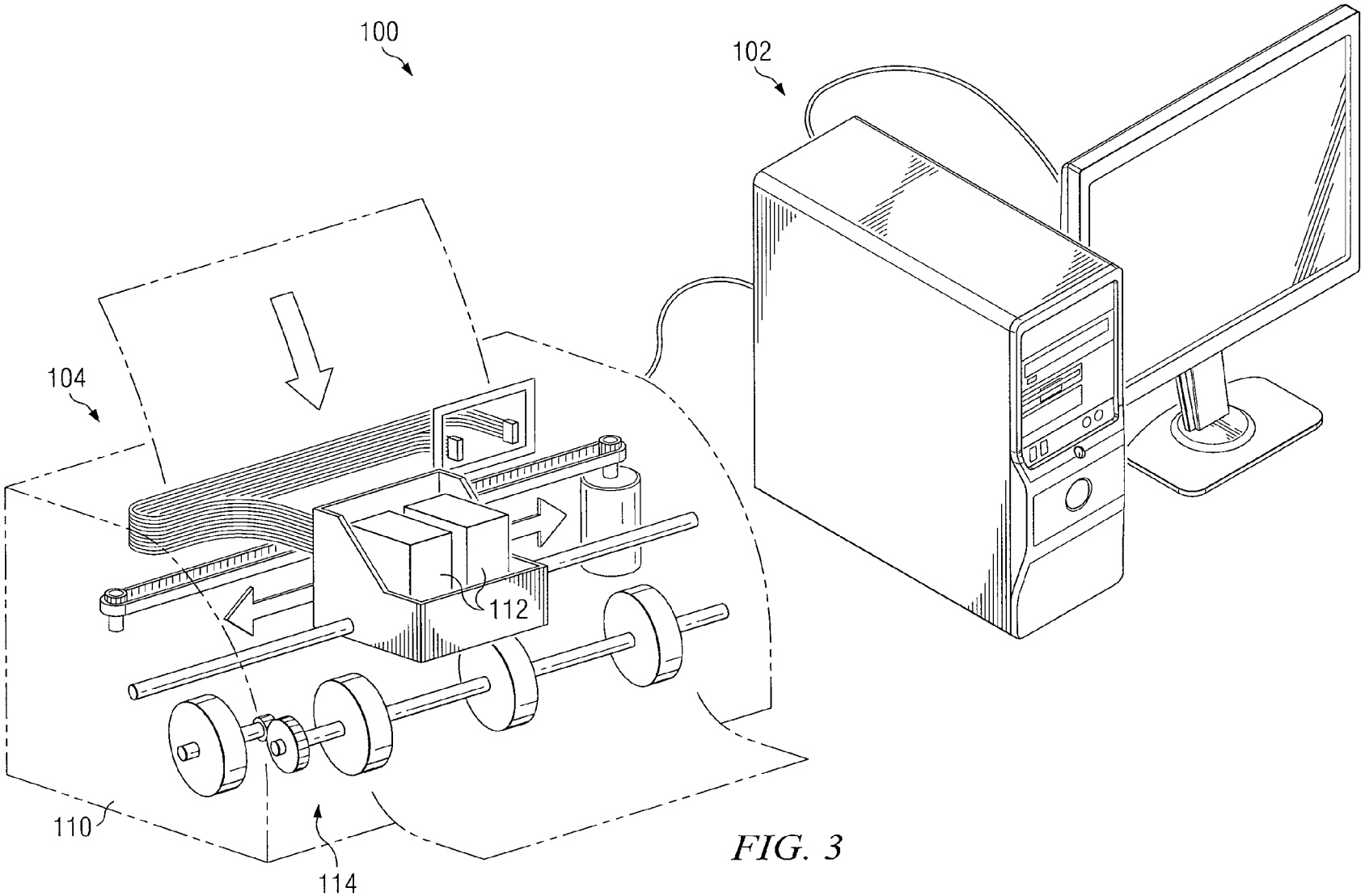
FIG. 3 illustrates a system including an information handling system and a printer including improved printer star wheels, according to certain embodiments of the present disclosure.

FIG. 3 illustrates an example system 100 including an information handling system 102 and a printer 104 including improved printer star wheels, in accordance with certain embodiments of the present disclosure. Information handling system 102 may comprise any type of information handling system discussed herein. For example, in some embodiments, information handling system 102 may comprise a desktop computer, a laptop, a workstation, or a server.

Printer 104 may comprise a printing device for printing documents, images, or other data from information handling system 102. Printer 104 may comprise any known type of printing device, e.g., a laser printer, an inkjet printer, a photo printer, a dot matrix printer, or a plotter.

Printer 104 may include a housing 110, one or more print cartridges 112, a positioning system 114, and any other known printer components. Housing 110 may comprise any structure for housing components of printer 104. A print cartridge 112 may include any container for holding ink, toner or other material to be transferred to a print medium (e.g., paper). Some cartridges 112 may also include a print head. In some embodiments, printer 104 may be a black and white printer or a color printer including any number of black and/or different colored ink cartridges 112 or print heads.

Positioning system 114 is configured to position print media (e.g., paper) for printing by the one or more print cartridges 112. For example, positioning system 114 may be configured to translate the print media through printer housing 110. Positioning system 114 includes one or more rotatable star wheels for securing and translating the print media by friction. As discussed below, according to embodiments of the present disclosure, one or more of such star wheels may be configured to secure and translate a print media (e.g., a photo paper) through the printer 104 without leaving star wheel marks or tracks on the surface of the print media.

Figure 4:
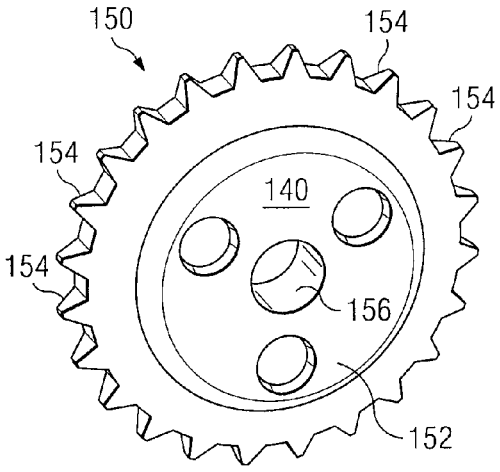
FIGS. 4 and 5 illustrate 3-dimensional views of a first side and an opposite second side of a printer star wheel, according to certain embodiments of the present disclosure.
Figure 5:
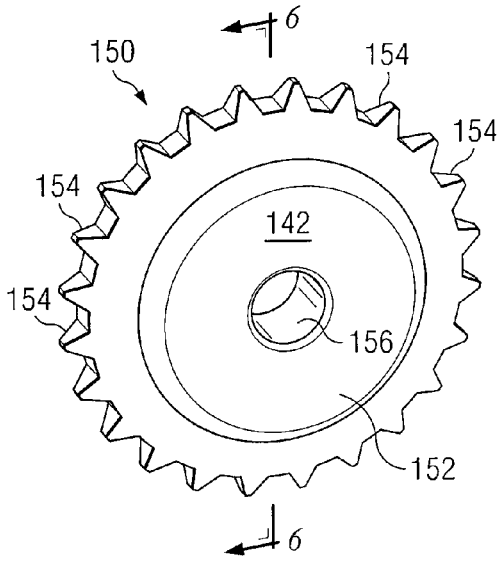

FIGS. 4 and 5 illustrate 3-dimensional views of a first side 140 and an opposite second side 142 of a star wheel 150, according to certain embodiments of the present disclosure. Star wheel 150 may include a body 152 and a number of teeth 154 positioned around an outer perimeter of body 152. An opening 156 may be formed through body 152 for connecting star wheel 150 to an axle or other structure configured to rotate (or allow rotation of) star wheel 150 during user.

Teeth 154 may be formed from plastic, e.g., acetal copolymer plastic or Acetal Homopolymer plastic. In some embodiments, star wheel 150 including body 152 and teeth 154 is formed as a single plastic part, e.g., by injection molding or other suitable plastic forming technique. In some embodiments, teeth 154 may be formed from plastic and connected to a non-plastic (e.g., metal) body 152 by any suitable means.

When used to translate a photo or other print media, plastic star wheel 150 (particularly with a suitable tooth tip radius, e.g., as discussed below) may produce no star wheel marks or tracks on the surface of the print media, or at least may produce fewer or less severe marks or tracks as compared with known metal star wheels. As discussed below with reference to FIG. 7, plastic star wheel 150 may produce similar friction to that produced by a known metal star wheel, with less penetration into the laminar structure of the print media as compared to the metal star wheel.

Figure 6:
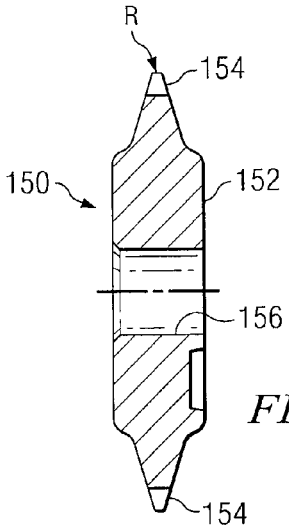
FIG. 6 illustrates a cross-sectional view of the star wheel of FIGS. 3-5, taken along line 6-6 shown in FIG. 5, according to certain embodiments of the present disclosure.

FIG. 6 illustrates a cross-sectional view of star wheel 150 of FIGS. 3-5, taken along line 6-6 shown in FIG. 5, according to certain embodiments of the present disclosure. In some embodiments, the tip of each tooth 154 of star wheel 150 may be rounded with a radius between about 0.25 mm and about 0.35 mm. In one embodiment, the tip of each tooth 154 has a radius of about 0.03 mm. Such tip radius (particularly when used with a plastic star wheel 150) may produce no star wheel marks or tracks on the surface of the print media, or at least may produce fewer or less severe marks or tracks as compared with known metal star wheels. As discussed below with reference to FIG. 7, star wheel 150 with a radius as described above may produce similar friction to that produced by a known metal star wheel, with less penetration into the laminar structure of the print media as compared to the metal star wheel.

Figure 1:
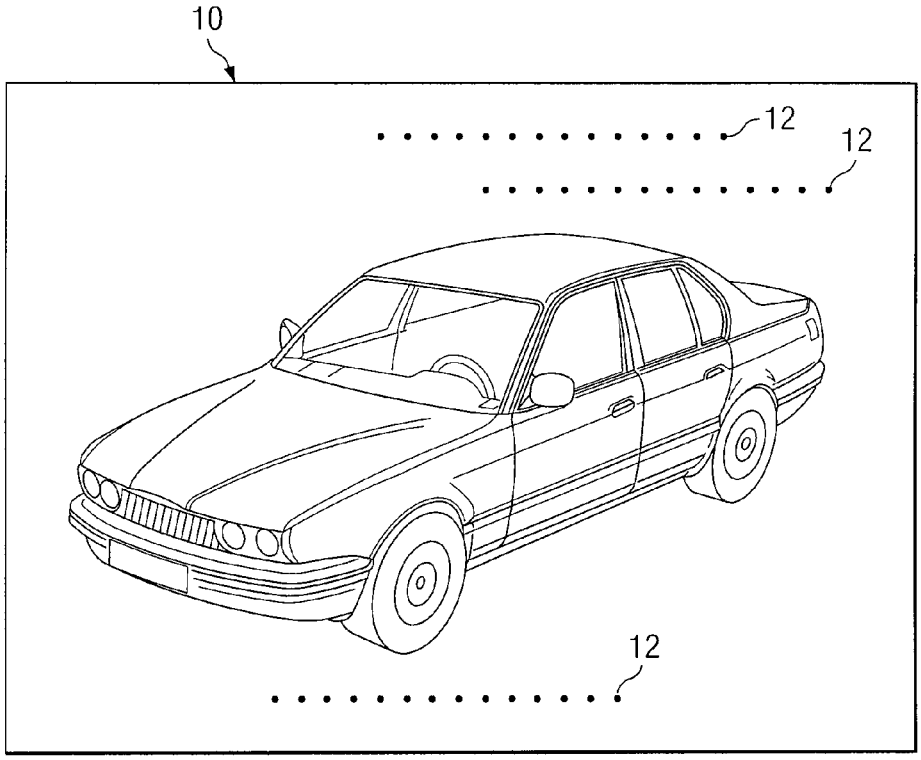
FIG. 1 (PRIOR ART)
FIG. 1 illustrates an example photograph including printer star wheel tracks common in the prior art.
Figure 2:
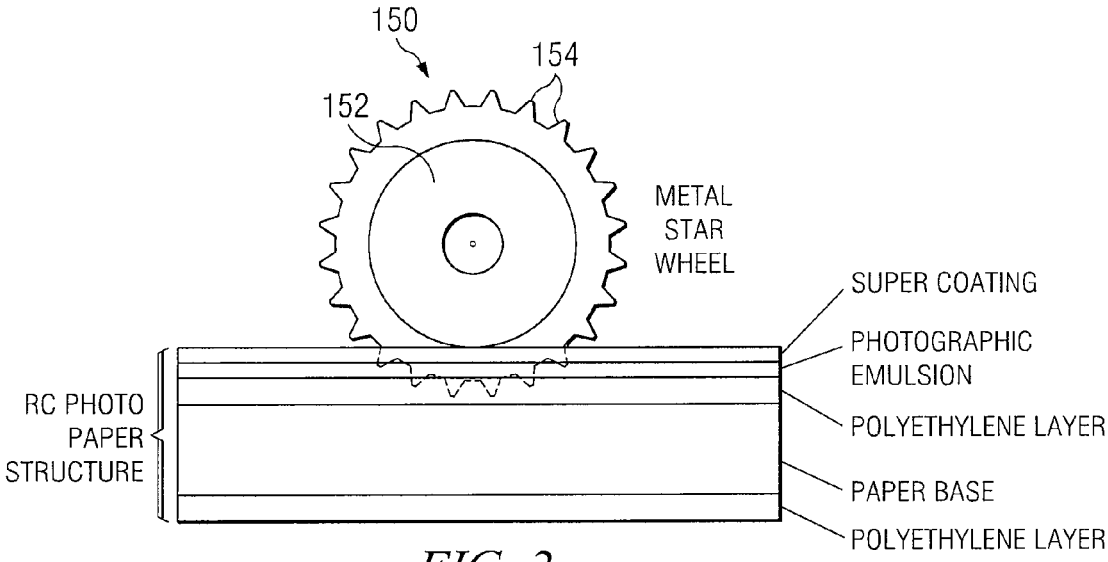
FIG. 2 (PRIOR ART)
FIG. 2 is a cross-sectional side view of a prior art printer star wheel penetrating into a polyethylene layer of a print media.
Figure 7:
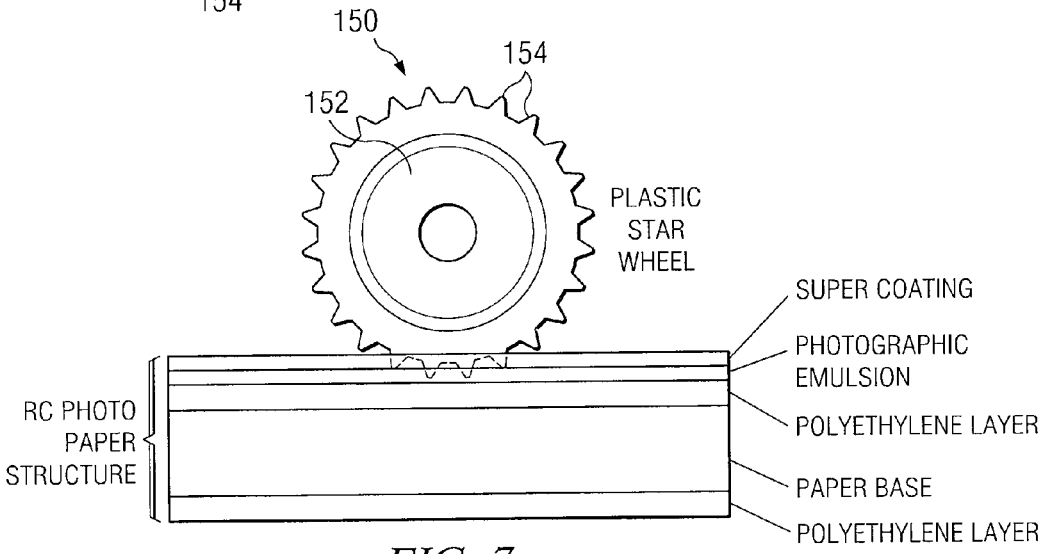
FIG. 7 is a cross-sectional side view of a printer star wheel penetrating into a photographic emulsion layer of a print media, according to certain embodiments of the present disclosure.

FIG. 7 is a cross-sectional side view of a printer star wheel 150 penetrating into a photographic emulsion layer of a photo paper structure, according to certain embodiments of the present disclosure. In certain embodiments, e.g., embodiments in which (a) star wheel 150 (or at least teeth 154) is formed from plastic and/or (b) teeth 154 of star wheel 150 have a radius between about 0.025 mm and about 0.035 mm, star wheel 150 may produce sufficient friction with the photo paper (e.g., a super-coated resin-coated (RC) paper) for effectively translating the photo paper, without penetrating into the photographic emulsion layer of the paper structure. For example, as shown in FIG. 7, teeth 154 may penetrate into a photographic emulsion layer, but not into the polyethylene layer below the photographic emulsion layer, yet provide sufficient friction with the paper for effectively translating the paper. This may be compared to prior art metal star wheels, which typically penetrate into or through the polyethylene layer, as shown in FIG. 2. Thus, because star wheel marks/tracks are substantially formed by penetration into the polyethylene layer, star wheels 150 according to the present disclosure may reduce or eliminate the formation of star wheel marks/tracks on the surface of the print media.

Although the present disclosure has been described in detail, it should be understood that various changes, substitutions, and alterations can be made hereto without departing from the spirit and the scope of the disclosure as defined by the appended claims.

What is claimed is:

1. A printer, comprising:

one or more print cartridges; and a star wheel including an outer perimeter and a plurality of plastic teeth with rounded tips disposed around the outer perimeter such that the plurality of plastic teeth are configured to translate a print media being printed to by the one or more cartridges without forming star wheel marks or tracks on a surface of the print media;

wherein the rounded tip of each of the plurality of plastic teeth has a radius between about 0.025 mm and about 0.035 mm.

2. A printer according to claim 1, wherein the rounded tip of each of the plurality of plastic teeth has a radius of about 0.03 mm.

3. A printer according to claim 1, wherein the plurality of plastic teeth are formed from acetal plastic.

4. A printer according to claim 1, wherein the star wheel is formed as a single plastic part.

5. A printer according to claim 1, wherein the star wheel is formed by injection molding.

6. A printer according to claim 1, wherein:

the print media is photo media including a photographic emulsion layer and a polyethylene layer below the photographic emulsion layer; and the plurality of plastic teeth penetrate into the photographic emulsion layer, but not into the polyethylene layer of the photo media.

7. A printer, comprising:

a housing;

one or more print cartridges; and a positioning system configured to position print media for printing by the one or more print cartridges, the positioning system including a rotatable star wheel for translating the print media relative to the housing, the star wheel including a plurality of plastic teeth with rounded tips disposed around an outer perimeter of the star wheel;

and wherein the rounded tip of each of the plurality of plastic teeth has a radius between about 0.025 mm and about 0.035 mm.

8. A printer according to claim 7, wherein the rounded tip of each of the plurality of plastic teeth has a radius of about 0.03 mm.

9. A printer according to claim 7, wherein the star wheel is formed from acetal plastic.

10. A printer according to claim 7, wherein the star wheel is formed by injection molding.

11. A printer according to claim 7, wherein:

the print media is photo media including a photographic emulsion layer and a polyethylene layer below the photographic emulsion layer; and the star wheel penetrates into the photographic emulsion layer, but not into the polyethylene layer of the photo media.

12. A printer according to claim 7, wherein the positioning system includes multiple star wheels, each formed from plastic.

* * * * *